US005104001A

United States Patent [19]

Negron

[11] Patent Number: 5,104,001

[45] Date of Patent: Apr. 14, 1992

[54] DISPENSER FOR ROLLS OF TOILET PAPER

[76] Inventor: Jose Negron, 400 Cozine Ave., Brooklyn, N.Y. 11207

[21] Appl. No.: 699,433

[22] Filed: May 13, 1991

[51] Int. Cl.[5] ..... B65G 59/00

[52] U.S. Cl. ..... 221/276; 221/303

[58] Field of Search ..... 221/276, 268, 270, 303, 221/306, 312 R

[56] References Cited

U.S. PATENT DOCUMENTS

| | | | |
|---|---|---|---|
| 1,624,883 | 4/1927 | Allen | 221/276 |
| 1,926,426 | 9/1933 | Blake | 221/276 |
| 2,015,628 | 9/1935 | Kanai | 221/276 |
| 2,902,187 | 9/1959 | Cabanban | 221/276 |
| 3,168,215 | 2/1965 | Vido | 221/276 |

*Primary Examiner*—Robert P. Olszewski
*Assistant Examiner*—Kenneth Noland
*Attorney, Agent, or Firm*—Howard M. Schwinger

[57] ABSTRACT

This invention relates to a dispenser for toilet paper and consists of a tube adapted to hold a stack of rolls, the tube being open at its upper end for loading and closed at its lower end by an end wall. A discharge opening is formed in the tube just above the end wall, A movable plate is supported by the end wall for pushing a roll through the discharge opening, the plate being spring biased. A slot is formed in the end wall, the plate having an arm depending therefrom, the arm extending through said slot to the exterior.

2 Claims, 1 Drawing Sheet

DISPENSER FOR ROLLS OF TOILET PAPER

This invention relates to a dispenser for rolls of toilet paper and more particularly to a tubular dispenser for stacked rolls.

BACKGROUND OF THE INVENTION

Although tubular dispensers for stacked rolls of toilet paper have been heretofore proposed, jams in the feed of the rolls from the dispenser have been encountered.

OBJECT OF THE INVENTION

It is thus the primary object of the present invention to provide a tubular dispenser for stacked rolls of toilet paper wherein jams are eliminated and the feed is smooth and uninterrupted.

It is another important object of the present invention to provide an inexpensive and reliable dispenser for rolls of toilet paper.

SUMMARY OF THE INVENTION

These and other objects are realized with a dispenser comprising a tube adapted to hold a stack of rolls, said tube being open at its upper end for loading, said tube being closed at its lower end by an end wall, a discharge opening formed in the tube just above the end wall, a movable plate supported by the end wall for pushing a roll through the discharge opening, said plate being spring biased, a slot formed in the end wall, said plate having an arm depending therefrom, said arm extending through said slot to the exterior.

Before explaining the invention in detail it is to be understood that the invention is not limited in its application to the details of construction and arrangement of parts illustrated in the drawings since the invention is capable of other embodiments and of being practiced or carried out in various ways. It is also to be understood that the phraseology or terminology employed is for the purpose of description and not of limitation.

The objects and advantages of the present invention will become apparent from a reading of the following detailed description when taken in conjunction with the accompanying drawing wherein FIG. 1 is a side elevation of an embodiment of a dispenser in accordance with the present invention with a portion of its lower wall broken away for clarity, FIG. 2 is a back view of the embodiment of FIG. 1, FIG. 3 is sectional view taken on line 3—3 of FIG. 1 in the direction of the arrows, and FIG. 4 is a sectional view taken on line 4—4 of FIG. 3, in the direction of the arrows, showing the spring as housed within the slot.

DETAILED DESCRIPTION OF THE VIEWS OF THE DRAWING

Figure 1:
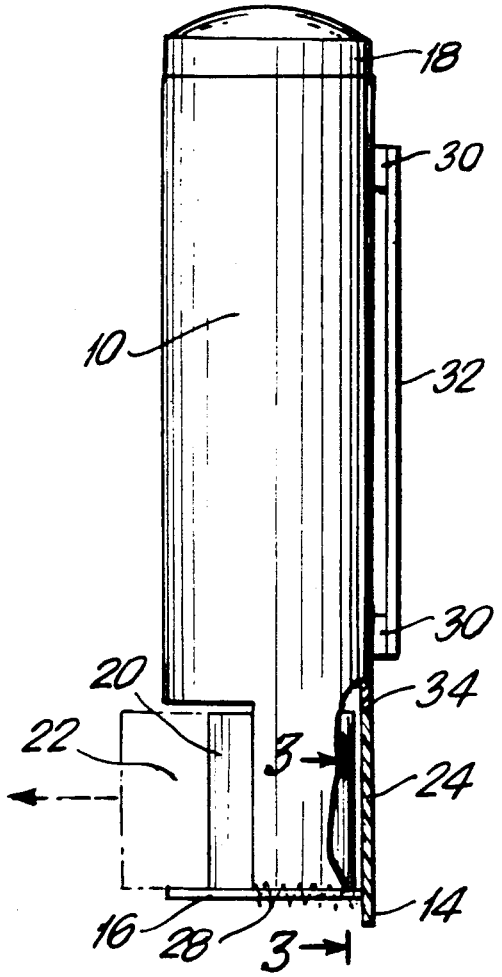
Figure 2:
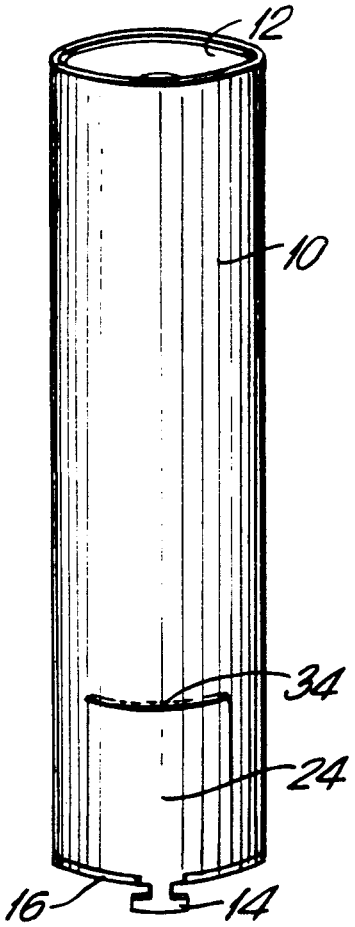
Figure 3:
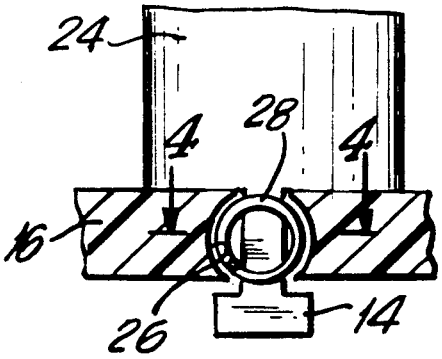
Figure 4:
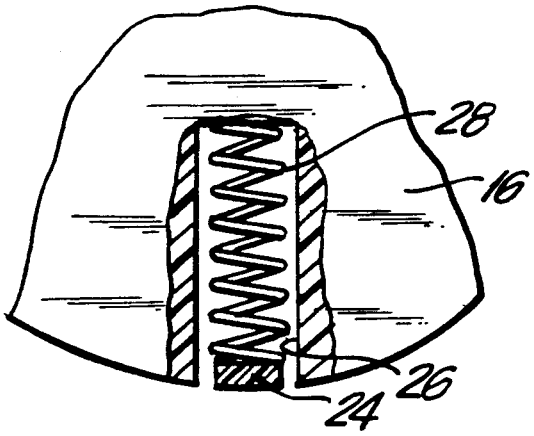

Referring to the drawing wherein similar reference characters designate corresponding parts throughout the several views, 10 is a cylinder open at top end 12. Its lower end is closed by wall 16. A cap 18 is provided for closing off the cylinder at its top end. Rolls of toilet paper 20 may be inserted into the cylinder through top end 12 when cap 18 is removed from the assemblage.

A discharge port 22 is formed in the wall of the lower portion of the cylinder permitting of the removal of rolls stored in the cylinder. A second opening (not shown) is formed in the cylinder wall opposite discharge port 22 to house push plate 24 mounted therein. Plate 24 is provided with an arm 14 which extends downwardly and terminates beneath the cylinder.

End wall 16 is provided with a tubular slot 26 for housing spring 28 which maintains push plate 24 flush with the cylinder wall by exerting force thereon. When it is desired to remove a roll a paper though discharge port 22 one need merely pull arm 24 against the action of spring 28 to move the push plate against a roll of paper and push the roll through the discharge port.

The spring returns the plate to the cylinder wall when the arm is released. The edges of plate 24 are tapered as at 34 as is the edge of the cylinder opening wherein the plate is housed. The tapered edges aids in the seating of the plate in the rest position and prevents it from moving outwardly of the cylinder.

Brackets 30 are provided on the exterior of cylinder 10 to support mounting plate 32.

The assemblage is preferably of a molded plastic composition.

It should be realized that by reason of the foregoing construction rolls of papers may be readily removed from the cylinder without the chance of jamming. It should be further realized that the embodiments herein described are only representative of the invention and it is not intended to limit the invention to these particular embodiments as the invention encompasses all embodiments falling with the spirit and scope of the appended claims.

I claim:

1. A dispenser for rolls of toilet paper comprising a tube adapted to hold a stack of rolls, said tube being open at its upper end for loading, said tube being closed at its lower end by an end wall, a discharge opening formed in the tube just above the end wall, a plate supported by the end wall for pushing a roll through the discharge opening, an opening in the tube wall to accommodate the plate, said plate being positioned in said opening flush with the tube, a slot formed in the end wall, said plate having an arm depending therefrom, said arm extending through said slot to the exterior, a spring disposed in said slot for urging the plate against the wall of the tube.

2. A dispenser in accordance with claim 1 wherein the edge of the plate and its mounting on the cylinder are reciprocally tapered for the flush seating of the plate against the cylinder wall.

* * * * *